United States Patent [19]

Heyn

[11] 4,407,424

[45] Oct. 4, 1983

[54] PLASTIC PLUG TYPE CLOSURE FOR BEVERAGE CONTAINERS

[75] Inventor: William M. Heyn, New Canaan, Conn.

[73] Assignee: The Continental Group, Inc., Stamford, Conn.

[21] Appl. No.: 394,231

[22] Filed: Jul. 1, 1982

[51] Int. Cl.[3] ..... B65D 17/34

[52] U.S. Cl. ..... 220/269; 220/260; 220/270; 220/354

[58] Field of Search ..... 220/260, 267, 269, 270, 220/307, 354

[56] References Cited

U.S. PATENT DOCUMENTS

| | | | |
|---|---|---|---|
| 3,235,121 | 2/1966 | Hexel | 220/260 |
| 3,967,749 | 7/1976 | Walter | 220/269 |
| 4,077,538 | 3/1978 | Waterbury | 220/269 |
| 4,232,797 | 11/1980 | Waterbury | 220/269 |

*Primary Examiner*—George T. Hall

*Attorney, Agent, or Firm*—John J. Kowalik; Charles E. Brown

[57] ABSTRACT

A closure for a container wherein the closure is made of plastic and is attached to the container by means of a web and bead, the bead being held captive within a channel which is inscribed within the pour opening and the bead, providing a sharp edge and being arranged in such manner with the pull tab which is adapted to release the closure to concentrate the forces against a sharp cutting edge provided on the channel.

10 Claims, 9 Drawing Figures

PLASTIC PLUG TYPE CLOSURE FOR BEVERAGE CONTAINERS

BACKGROUND OF THE INVENTION

This invention is directed primarily to beverage containers and particularly to plastic closures therefor. Various closures for beverage containers are available, many of which comprise scored end panels on end members which are seamed to a can body. Plastic closures comprise friction type plugs or interlocking arrangements between the plastic closure and the metal can portion or the plastic is connected to the can in such way that the plastic is torn off to open the can.

SUMMARY OF THE INVENTION

The instant invention is concerned with facilitating fabrication of a plastic to metal closure which is easy to open and which does not interfere with the conventional securement of the end member to the can body.

A particular object is to provide in the end panel an endless circumscribing channel, a pour opening over which a plastic web is overlaid, the web having a peripheral bead formed integral therewith and the bead complementally fits into the channel which is tightly crimped about the bead to effect a seal therewith, a cuttiing edge being provided along the free edge of the channel for cutting the bead upon the closure web being lifted.

A further object is to provide a novel interlocking arrangement between the channel and bead in which the raw edge of the channel is buried into the bead to prevent exposure to the contents of the can, and wherein the bead upon being torn apart remains as a protective lip about the margin of the pour opening to prevent injury to the user.

The invention contemplates the utilization of the channel as a rigidifying structure to prevent the panel from buckling due to pressure of the contents of the container and thus loosening the seal between the bead and the channel walls.

Another object is to provide a novel, thin frangible web connection between the sealing panel and the bead which is pinched between the opposed edges of the channel which is crimped about the bead to effect the seal.

These and other objects and advantages will become apparent from the specification and drawings wherein.

Figure 6:
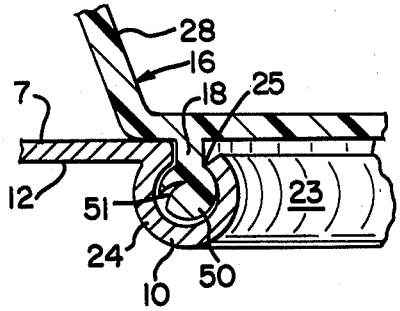
FIGS. 6 and 7 illustrate a bead structure formed to facilitate its rupture for opening.

FIG. 6 showing the parts in closed position; and

Figure 7:
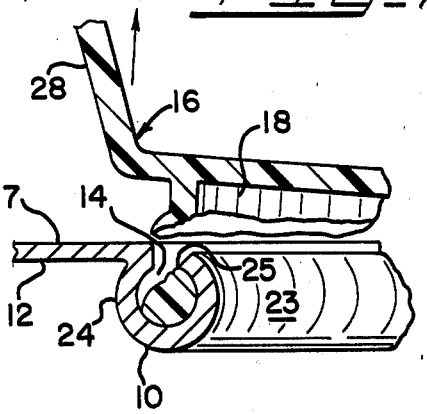
Figure 8:
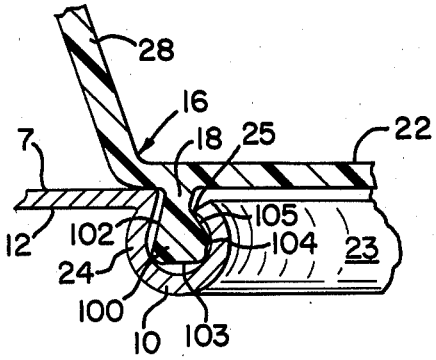
Figure 9:
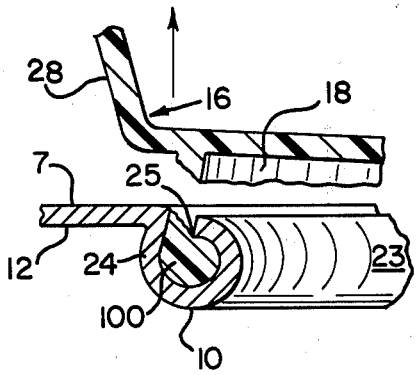

FIG. 7 showing the seal torn apart;

FIGS. 8 and 9 illustrate a closure with a bead of somewhat trapezoidal shape in cross-section in position to be crimped in the channel, FIG. 9 showing the closure being torn away from the end panel.

DESCRIPTION OF FIGS. 1–5

The invention is disclosed with a metal can generally designated 2 comprising a body 3 and an end member 5 which is double seamed at 6 to the body in usual manner.

The end member has a center panel 7 which is provided with a pour opening 8. The margin of opening 8 inscribes an endless channel 10. The channel 10 projects from the reverse side 12 of the panel into the container and is generally cylindrical in cross-section and is open in an upward direction providing a gap 14 for insertion of an endless bead 15 of a plastic closure 16.

Figure 2:
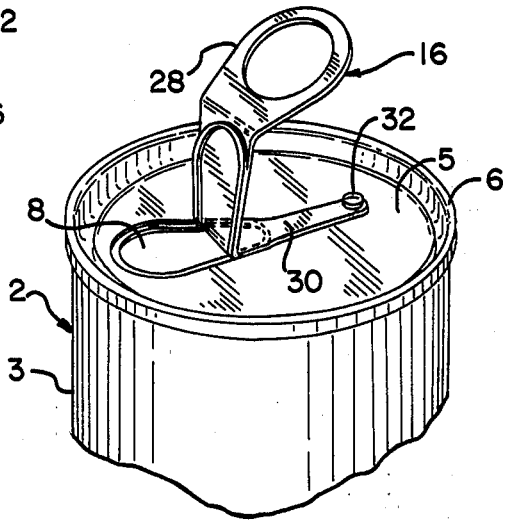
FIG. 2 is a fragmentary perspective view showing the closure in partly open position.
Figure 3:
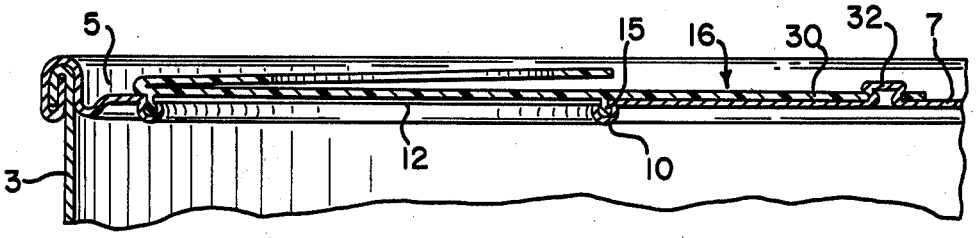
FIG. 3 is an enlarged cross-section taken substantially on line 3—3 of FIG. 1.
Figure 4:
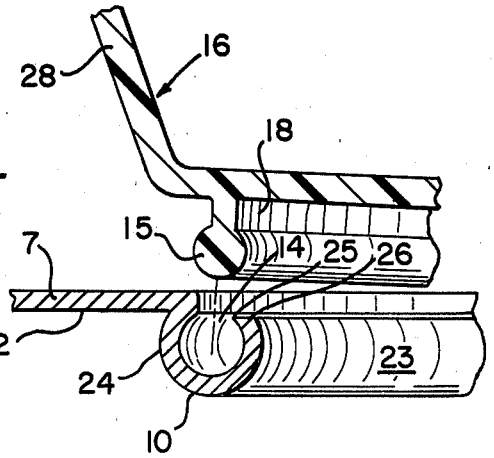
FIG. 4 is an enlarged cross-section showing the closure and can end member in position preparatory to assembly.
Figure 5:
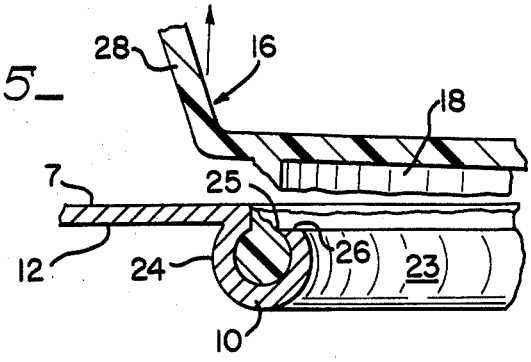
FIG. 5 illustrates the closure torn apart in the process of opening it.

The bead 15 is formed on the lower edge of a thin web 18. In this embodiment the bead is of cylindrical shape in cross-section. The upper edge of web 18 is integrally formed with the flat body portion 20 of the closure 16. The body portion 20 overlies the opening 8 in closing position (FIG. 3). The channel is crimped against the web 18 by rolling the inner wall 23 of the channel toward the outer wall 24 to close the gap and to advance the sharp corner 25 into the web 18 and to bury the uncoated edge 26 into the plastic material of the web. Thus the sharp corner 25 is optimally positioned to cut the web when the handle or pull tab 28 of portion 8 of the closure, which normally is laid over the body portion as seen in FIG. 1, is lifted and pulled to open the closure as seen in FIG. 2.

The body portion has an integral tether 30 which is secured as by a rivet 32 to the end panel so that the closure is non-detachable.

One of the features of the present invention is that in providing the channel or curl within the confines of the opening the adjacent area of the end panel is rigidified so that upon the container being filled with pressurized fluid, the end panel will not bulge or otherwise deflect thus preventing distortion of the metal and possible leaking. Also when the closure is being lifted for opening the rigidity facilitates cutting of the plastic closure which may be polyethylene, polypropylene or other well known plastic material.

Figure 1:
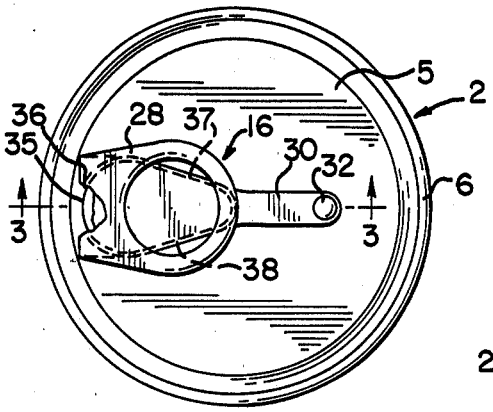
FIG. 1 is a top plan view of a container incorporating my invention.

As best seen in FIG. 1 a feature of the present invention is in an arrangement wherein the pull forces for opening are concentration at the point of tangency 35 (FIG. 1) of the connection of the web 18 and the pull tab 28 to the arcuate leading edge 36 of the cutting apex 25 of the channel. Once the cut is started it then easily progresses along the lateral legs 37, 38 of the tear drop shaped channel which follows the outline of the opening.

DESCRIPTION OF FIGS. 6 AND 7

In this embodiment as well as in the next one the parts which are the same as those in the previous embodiment will be identified by the same reference numerals. The principal difference is that the bead 50 has a slit 51 about its entire outer periphery to weaken the bead proximate its juncture with the web 18. Thus when the closure is opened the bead with tear somewhat chordally as best seen in FIG. 7 and tearing is facilitated.

DESCRIPTION OF FIGS. 8 AND 9

In this embodiment the bead 100 is formed generally trapezoidal in cross section and provides flat faces 102, 103, 104 and 105 defining space sectors opposing contiguous cylindrical wall sections of the channel which allows the plastic material bulge space while permitting a tighter curling of the channel and allowing the knife-apex 25 to be directed downwardly and the web 18 to be thinned and stretched in tension.

Having described several embodiments of the invention, other variations will become apparent to those skilled in the art and which come within the scope of the appended claims.

What is claimed is:

1. A closure for a pour opening in a wall of a container, a channel on the wall inscribed within said opening, a plastic closure having a body portion overlying the opening and a rupturable web extending from one side of said body portion into said channel, a retainer bead having a juncture with said web, said bead being positioned in said channel, said channel having a wall crimped about said bead and having a cutting edge imbedded into said bead at said juncture for severing said web attendant to said body portion of the closure being lifted for opening said container.

2. The invention according to claim 1 and said cutting edge having an arcuate leading end and body lifting means being connected to said body along a line of tangency with said arcuate leading edge for concentrating the lifting forces at the point of tangency to facilitate cutting said web.

3. The invention according to claim 1 and said bead having tear-initiating peripheral cut positioned proximate to said cutting edge.

4. The invention according to claim 1 and said bead having a plurality of flat sides and said channel being generally cylindrical in cross-section and with said sides of the bead providing regions for bulging of the bead whereby said channel is adapted to be tightly curled about the bead and said cutting edge is directed generally parallel to said rupturable web to optimize its cutting capability.

5. The invention according to claim 1 and said bead being of generally trapezoidal form and said channel being generally cylindrical and defning voids therebetween accommodating bulging of the material of the plastic into said voids and tight curling of the channel about said bead, said web upon curling of said channel drawing said web taut and pinching said web into a thin section between opposing sections of said channel.

6. A closure for a container having a thin metal end member comprising a normally bulgeable thin center panel with a pour opening therein, a channel formed from said panel inscribed within said opening, said channel comprising a gap facing through said opening, a closure having a plastic body portion covering said opening, a web integral with said body portion projecting through said opening and said gap into said channel, and a bead on the free edge of said web confined within said channel.

7. The invention according to claim 6 and said web being pinched into a thin cross-section between opposing portions of said channel at said gap, means on one of said channel portions for cutting said web attendant to lifting of said body portion.

8. The invention according to claim 6 and means for cutting said web attendant to lifting of said body portion.

9. The invention according to claim 8 and means for lifting and concentrating lifting forces on said body portion at a preselected point to initiate cutting of said web.

10. The invention according to claim 7 and said web upon being torn apart having portions shielding said cutting means.

* * * * *